US010672598B2

(12) United States Patent
VanGordon

(10) Patent No.: US 10,672,598 B2
(45) Date of Patent: Jun. 2, 2020

(54) METHODS FOR TESTING OR ADJUSTING A CHARGED-PARTICLE DETECTOR, AND RELATED DETECTION SYSTEMS

(71) Applicant: bioMerieux, Inc., Durham, NC (US)

(72) Inventor: James Arthur VanGordon, O'Fallon, MO (US)

(73) Assignee: bioMerieux, Inc., Durham, NC (US)

( * ) Notice: Subject to any disclaimer, the term of this patent is extended or adjusted under 35 U.S.C. 154(b) by 0 days.

(21) Appl. No.: 16/272,537

(22) Filed: Feb. 11, 2019

(65) Prior Publication Data

US 2019/0252167 A1 Aug. 15, 2019

Related U.S. Application Data

(60) Provisional application No. 62/629,840, filed on Feb. 13, 2018.

(51) Int. Cl.

| | |
|---|---|
| ***H01J 49/02*** | (2006.01) |
| ***H01J 49/26*** | (2006.01) |
| ***H01J 49/00*** | (2006.01) |

(52) U.S. Cl.
CPC ..... *H01J 49/0009* (2013.01); *H01J 49/025* (2013.01)

(58) Field of Classification Search
CPC .. H01J 49/0009; H01J 49/0031; H01J 49/025; H01J 49/164
See application file for complete search history.

(56) References Cited

U.S. PATENT DOCUMENTS

| | | | | |
|---|---|---|---|---|
| 5,625,184 | A | 4/1997 | Vestal et al. | |
| 5,627,369 | A | 5/1997 | Vestal et al. | |
| 5,760,393 | A | 6/1998 | Vestal et al. | |
| 5,770,859 | A | 6/1998 | Bielawski | |
| 6,614,021 | B1 | 9/2003 | Kalinitchenko | |
| 7,005,646 | B1 * | 2/2006 | Jordanov | G01T 1/208 250/207 |
| 7,807,963 | B1 * | 10/2010 | Bier | H01J 49/422 250/281 |
| 8,735,810 | B1 | 5/2014 | Vestal | |
| 9,536,726 | B2 | 1/2017 | VanGordon et al. | |
| 2002/0020817 | A1 * | 2/2002 | Feller | H01J 49/025 250/397 |
| 2011/0155901 | A1 | 6/2011 | Vestal | |
| 2011/0180696 | A1 * | 7/2011 | Gessner | G01J 1/04 250/234 |
| 2013/0146778 | A1 | 6/2013 | Nuetzel et al. | |
| 2013/0240907 | A1 | 9/2013 | Nutzel et al. | |

(Continued)

OTHER PUBLICATIONS

International Search Report corresponding to International Application No. PCT/US2019/017437 (dated Jun. 11, 2019).

(Continued)

*Primary Examiner* — Eliza W Osenbaugh-Stewart
(74) *Attorney, Agent, or Firm* — Myers Bigel, P.A.

(57) ABSTRACT

Methods for testing or adjusting a charged-particle detector are provided. A diagnostic and/or adjustment method for a charged-particle detector of an instrument includes providing, from a photon source, photons incident on the charged-particle detector. Moreover, the method includes detecting a response by the charged-particle detector to the photons incident thereon. Related detection systems are also provided.

24 Claims, 17 Drawing Sheets

(56) References Cited

U.S. PATENT DOCUMENTS

2014/0339423 A1* 11/2014 Kim ..... H01J 49/0022
250/288
2015/0048245 A1 2/2015 Vestal et al.

OTHER PUBLICATIONS

Li et al. "Performance of a New 235 nm UV-LED-Based On-Capillary Photometric Detector" Anal. Chem. 88(24):12116-12121 (2016) (Abstract Only).
Vestal et al. "High Performance MALDI-TOF mass spectrometry for proteomics" International Journal of Mass Spectrometry 268(12):83-92 (2007).
Vestal, Marvin L. "Modern MALDI time-of-flight mass spectrometry" Journal of Mass Spectrometry 44:303-317 (2009).
Vestal et al. "Resolution and Mass Accuracy in Matrix-Assisted Laser Desorption Ionization-Time-of-Flight" Journal of the American Society for Mass Spectrometry 9:892-911 (1998).
Wiley et al. "Time-of-Flight Mass Spectrometer with Improved Resolution" The Review of Scientific Instruments 26(12):1150-1157 (1955).

* cited by examiner

METHODS FOR TESTING OR ADJUSTING A CHARGED-PARTICLE DETECTOR, AND RELATED DETECTION SYSTEMS

RELATED APPLICATIONS

This application claims the benefit of and priority to U.S. Provisional Application Ser. No. 62/629,840, filed Feb. 13, 2018, the contents of which are hereby incorporated by reference as if recited in full herein.

FIELD

The present invention relates to mass spectrometers and other instruments that detect charged particles.

BACKGROUND

Mass spectrometers are devices that ionize a sample and then determine the mass-to-charge ratios of the collection of ions formed. One well-known mass spectrometer is the Time-Of-Flight Mass Spectrometer (TOFMS), in which the mass-to-charge ratio of an ion is determined by the amount of time required for that ion to be transmitted under the influence of electric fields from the ion source to a detector. The spectral quality in the TOFMS reflects the initial conditions of the ion beam prior to acceleration into a field free drift region. Specifically, any factor that results in ions of the same mass having different kinetic energies and/or being accelerated from different points in space may result in a degradation of spectral resolution and, thereby, a loss of mass accuracy.

Matrix-Assisted Laser Desorption Ionization (MALDI) is a well-known method to produce gas-phase biomolecular ions for mass spectrometric analysis. The development of Delayed Extraction (DE) for MALDI-TOF has made high-resolution analysis routine for MALDI-based instruments. In DE-MALDI, a short delay is added between the ionization event, triggered by the laser, and the application of the accelerating pulse to the TOF source region. The fast (i.e., high-energy) ions will travel farther than the slow ions, thereby transforming the energy distribution upon ionization to a spatial distribution upon acceleration (in the ionization region prior to the extraction pulse application).

See U.S. Pat. Nos. 5,625,184, 5,627,369, 5,760,393, and 9,536,726. See also, Wiley et al., *Time-of-flight mass spectrometer with improved resolution*, Review of Scientific Instruments vol. 26, no. 12, pp. 1150-1157 (2004); M. L. Vestal, *Modern MALDI time-of-flight mass spectrometry*, Journal of Mass Spectrometry, vol. 44, no. 3, pp. 303-317 (2009); Vestal et al., *Resolution and mass accuracy in matrix-assisted laser desorption ionization-time-of-flight*, Journal of the American Society for Mass Spectrometry, vol. 9, no. 9, pp. 892-911 (1998); and Vestal et al., *High Performance MALDI-TOF mass spectrometry for proteomics*, International Journal of Mass Spectrometry, vol. 268, no. 2, pp. 83-92 (2007). The contents of these documents are hereby incorporated by reference as if recited in full herein.

SUMMARY

Embodiments of the present invention are directed to methods for testing or adjusting (e.g., calibrating/tuning) an ion detector or other charged-particle detector. A diagnostic and/or adjustment method for a charged-particle detector of an instrument may, according to some embodiments, include providing, from a photon source, photons incident on the charged-particle detector. Moreover, the method may include detecting a response by the charged-particle detector to the photons incident thereon.

In some embodiments, the charged-particle detector may include an ion detector, the photon source may include a Light-Emitting Diode (LED), and the detecting may include determining whether the ion detector provides an output signal in response to light from the LED. The providing photons may, in some embodiments, be carried out by pulsing the light from the LED. In some embodiments, the method may include comparing a signal gain of the ion detector with a predetermined value or with a measured signal gain of another ion detector, in response to the output signal of the ion detector. Moreover, the method may include adjusting the signal gain of the ion detector, in response to determining that the signal gain of the ion detector does not match the predetermined value and/or does not match the measured signal gain of the another ion detector.

Additionally or alternatively, the method may include varying current of the LED that generates the light, and adjusting a signal gain of the ion detector. Moreover, in some embodiments, the LED may be an UltraViolet (UV) LED, the providing photons may include changing a first current of the UV LED to a second greater or lesser current of the UV LED, and the method may include determining that the ion detector is functioning properly, in response to determining that a change from a first output signal of the ion detector to a second output signal of the ion detector is proportional to the change of the first current of the UV LED to the second current of the UV LED.

In some embodiments, the method may include removing one or more portions of an ion optics system from a housing of the instrument that includes a flight tube that is in communication with the charged-particle detector, and the providing photons may be performed while the one or more portions of the ion optics system is removed. In some embodiments, the providing photons may include applying current to the photon source to provide the photons incident on a Micro-Channel Plate (MCP) of the charged-particle detector.

Additionally or alternatively, the method may include determining whether ions are arriving at the charged-particle detector, and the providing photons may be performed without providing ions to the charged-particle detector, in response to determining that the ions are arriving at the charged-particle detector. Moreover, the method may include determining whether the ions are being generated by light from a light source, before the determining that the ions are arriving at the charged-particle detector. The method may also include determining that no signal is being generated by a mass spectrometer including the charged-particle detector, and the determining whether the ions are being generated by the light from the light source may be performed in response to the determining that no signal is being generated by the mass spectrometer.

In some embodiments, the method may include varying optical power of the photon source.

A method for evaluating and/or adjusting an ion detector of a mass spectrometer may, according to some embodiments, include applying current to a Light-Emitting Diode (LED) that is in communication with the ion detector. The method may also include detecting a response by the ion detector to a photon output that is generated by the applying the current to the LED, without any ionizing event in the mass spectrometer.

In some embodiments, the method may include testing a dynamic range of the ion detector by varying the current of the LED, and measuring the response by the ion detector to a range of photon outputs generated by the varying the current of the LED. Additionally or alternatively, the method may include removing one or more portions of an ion optics system from a housing of the mass spectrometer that includes a flight tube that is in communication with the ion detector, and the applying and detecting may be performed while the one or more portions of the ion optics system is removed. Moreover, the method may include installing the LED inside the housing, after removing the one or more portions of the ion optics system, before the applying and detecting.

In some embodiments, the method may include determining whether ions are being generated inside the mass spectrometer by light from a light source different from the LED. The method may also include determining whether the ions are arriving at the ion detector, and the applying and detecting may be performed in response to the determining that the ions are arriving at the ion detector. Additionally or alternatively, the LED may be an UltraViolet (UV) LED.

A detection system, according to some embodiments, may include a housing enclosing an analysis flow path. The detection system may include a charged-particle detector. The detection system may include a light source configured to provide light inside the housing to generate ions incident on the charged-particle detector. Moreover, the detection system may include a photon source configured to generate photons incident on the charged-particle detector.

In some embodiments, the detection system may include a flight tube in the housing and defining a free drift portion of the analysis flow path. The charged-particle detector may be in communication with the flight tube and may include a Micro-Channel Plate (MCP). In some embodiments, the photon source may be at or adjacent a base portion of the flight tube.

In some embodiments, the flight tube may include first and second cylinders, and the photon source may be between the first and second cylinders. For example, the photon source may be adjacent a perforated portion of one of the first and second cylinders.

Additionally or alternatively, the detection system may include a mass spectrometer that includes the housing, the charged-particle detector, the light source, and the photon source. In some embodiments, the light source may be a laser.

In some embodiments, the photon source may be a Light-Emitting Diode (LED) configured to generate LED light to provide the photons incident on the charged-particle detector. The LED may be in series with a resistor including a resistance value that is between 3 Ohms and 19,500 Ohms. Additionally or alternatively, the LED may be an UltraViolet (UV) LED that is releasably mountable in the housing.

In some embodiments, the detection system may include an ion optics system through which the ions are configured to pass toward the charged-particle detector. The ion optics system may be a removable ion optics system. Additionally or alternatively, the photon source may be permanently mounted in the housing in or adjacent the ion optics system.

Further features, advantages, and details of the present invention will be appreciated by those of ordinary skill in the art from a reading of the figures and the detailed description of the example embodiments that follow, such description being merely illustrative of the present invention.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally-filed claim or file any new claim accordingly, including the right to be able to amend any originally-filed claim to depend from and/or incorporate any feature of any other claim although not originally claimed in that manner. These and other objects and/or aspects of the present invention are explained in detail in the specification set forth below.

BRIEF DESCRIPTION OF THE DRAWINGS

FIGS. 3A and 3B are partially transparent side perspective views of an internal portion of an instrument with a photon source. FIG. 3C is a partially exploded view of a photon source and a flight tube. FIG. 3D is a view of a sub-assembly of an instrument including a photon source and a detector. FIG. 3E is a schematic diagram of an LED and a detector.

DETAILED DESCRIPTION

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10''').

During assembly (and/or during operation) of a mass spectrometry instrument/system, it may be advantageous to have a diagnostic to confirm the operation of, such as the generation of an output signal by, a detector outside of the scope of normal operation of the instrument/system with mass spectra. According to embodiments of the present invention, such a diagnostic may be provided via a mechanism for testing or adjusting the detector in situ independently of (i.e., without the need for) ion generation due to, for example, a MALDI process, and ion arrival at the detector. For example, a photon source may be used to test or adjust the detector when no mass spectra are being generated. Moreover, the photon source may be an unfocused photon source, which can allow for slight misalignment of the photon source because a portion of the photons that are generated may be reflected and/or scattered in the direction of the detector.

Figure 1A:
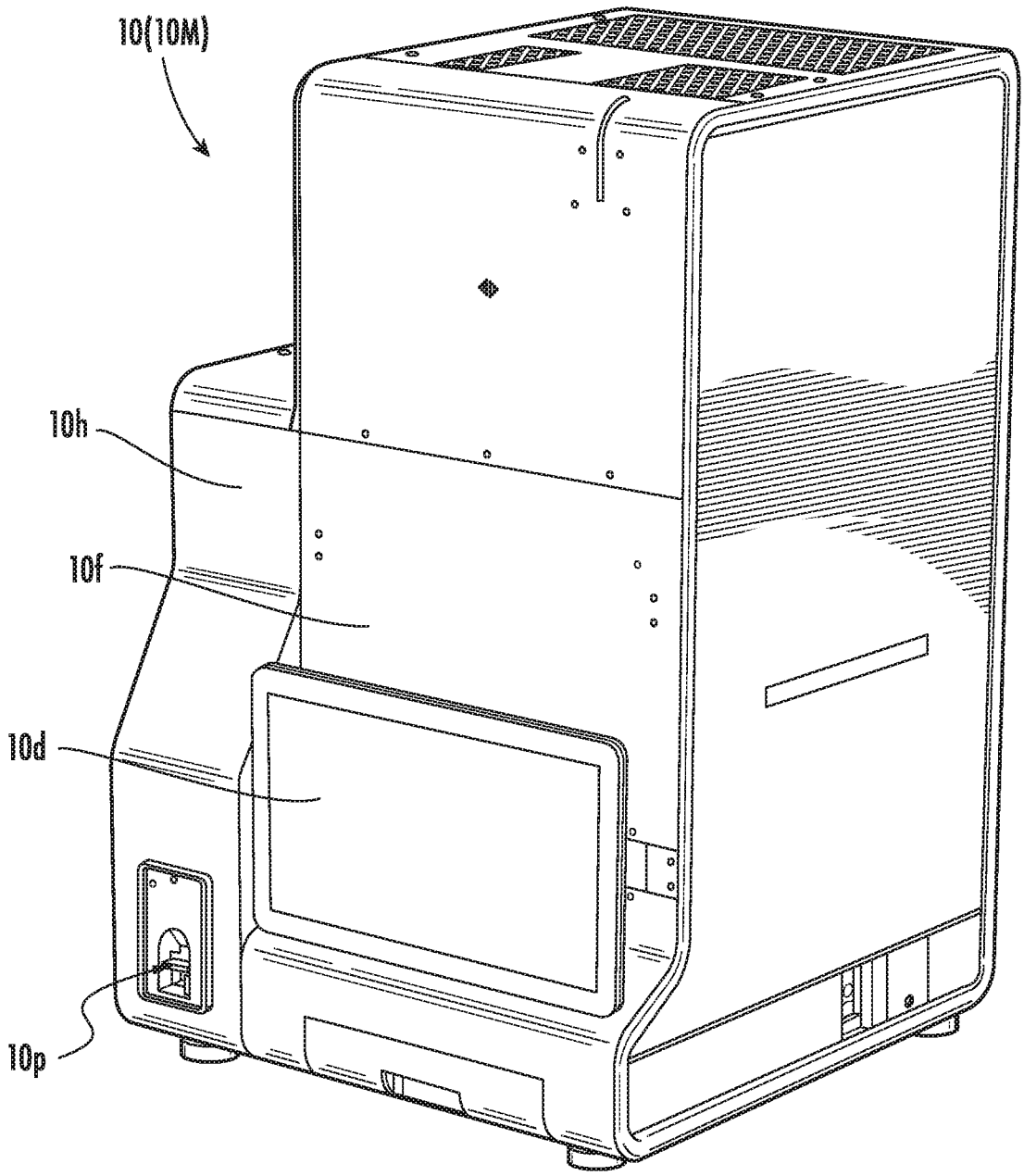
FIG. 1A is a perspective view of an instrument, according to embodiments of the present invention.
Figure 1B:
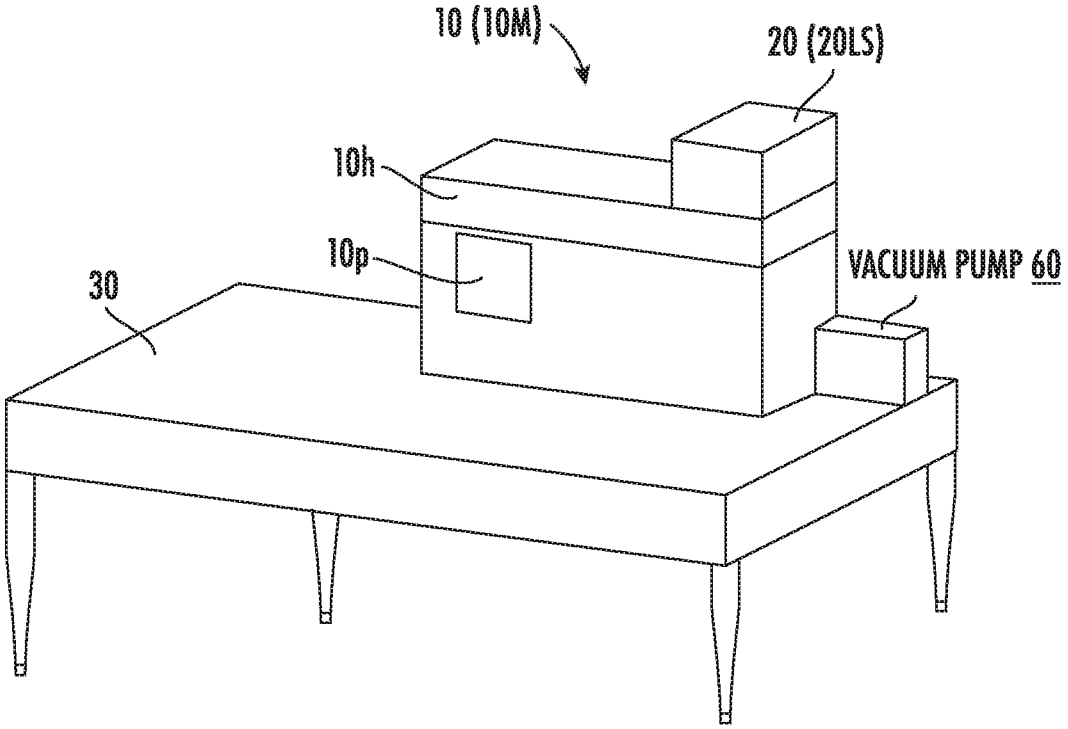
FIG. 1B is a perspective view of an instrument and a light source, according to embodiments of the present invention.

FIG. 1A and FIG. 1B illustrate an example instrument 10, such as a mass spectrometer 10M. As shown in FIG. 1A, the instrument 10 includes a housing 10*h* with a front wall 10*f* having a display 10*d* with a user interface. The housing 10*h* also has at least one sample specimen entry port 10*p* that can be sized and configured to receive slides. One or more ports 10*p* may be used. Each port 10*p* can be configured as entry-only, exit-only, or as both an entry- and exit-port for specimen slides (e.g., for a sample plate 230 of FIG. 2A) for analysis.

As shown in FIG. 1B, an instrument 10 may use at least one light source 20, according to embodiments of the present invention. In some embodiments, the instrument 10 may be a mass spectrometer 10M, and its housing 10*h* may include at least one sample specimen entry port 10*p* configured to receive slides for the mass spectrometer 10M. For example, the mass spectrometer 10M may be a table top mass spectrometer, as shown by the table 30. Moreover, one or more portions of the instrument 10 may be pumped/evacuated via a vacuum pump 60 to a desired pressure. The vacuum pump 60 and/or the light source 20 may be on board (e.g., inside) the housing 10*h* or may be provided as an external plug-in component to the instrument 10.

The at least one light source 20 can provide light to generate ions inside the instrument 10. For example, the light source 20 may comprise a laser 20LS that supplies laser light to the instrument 10. As an example, the laser 20LS may be a solid state laser, such as a UV laser with a wavelength above 320 nanometers (nm). In some embodiments, the solid state laser 20LS can generate a laser beam with a wavelength between about 347 nm and about 360 nm. The solid state laser 20LS can alternatively be an infrared laser or a visible light laser.

Moreover, although the terms "light source" and "laser" are used to discuss examples herein, the light source 20 may comprise any type of source that generates charged particles inside the instrument 10 by supplying light/energy to a target/device inside the instrument 10. For example, the light source 20 may be configured to provide one of various types of pulses of light/energy to a sample plate 230 (FIG. 2A) in the instrument 10 to generate a pulse of charged particles. In some embodiments, the light source 20 and the sample plate 230 may collectively (or even individually) be referred to as an "ion source," as light from the light source 20 may be directed to the sample plate 230 to generate ions.

Figure 2A:
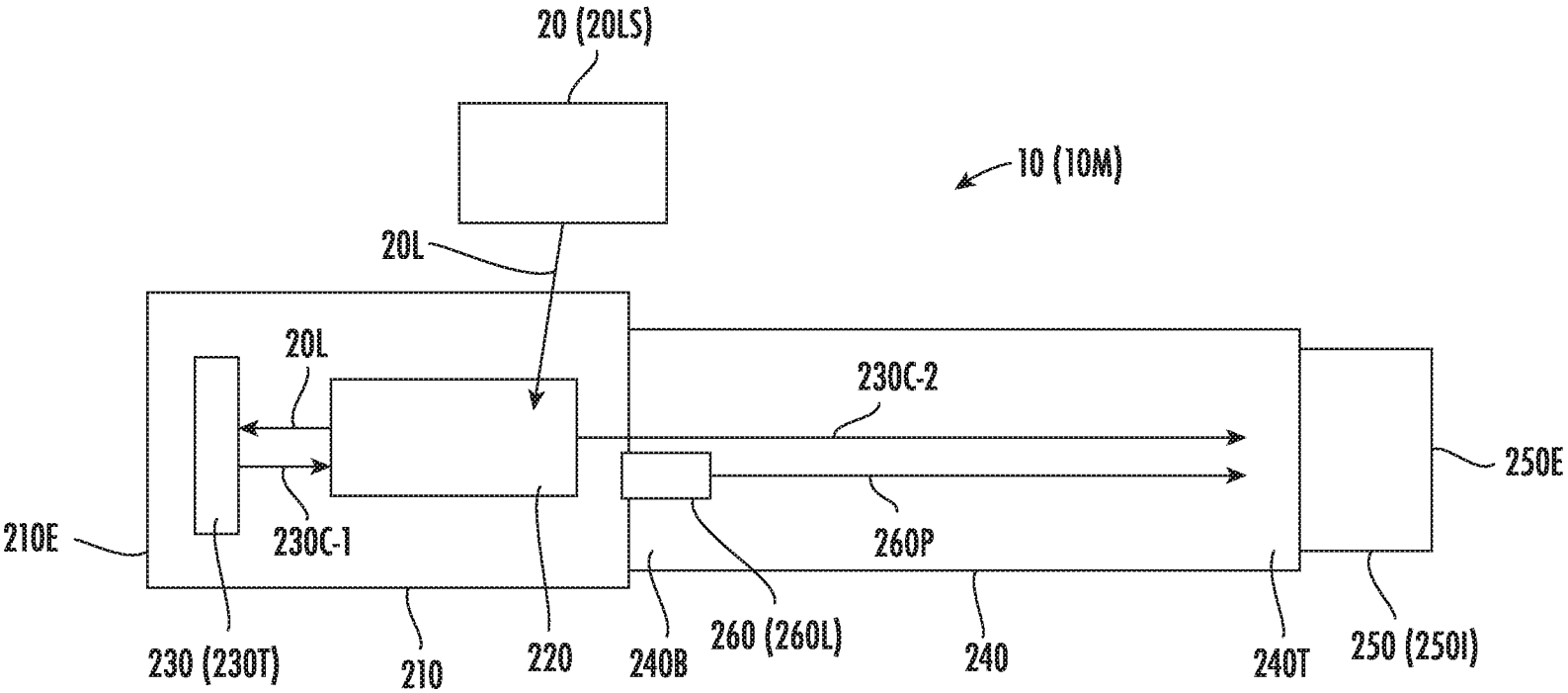
FIG. 2A is a schematic diagram of an instrument and a light source, according to embodiments of the present invention.

FIG. 2A illustrates a schematic diagram of an instrument 10 and a light source 20. The instrument 10 includes a chamber 210, which may be an "acquisition chamber," a "process chamber," a "vacuum chamber," a "chamber under vacuum," or a "chamber in vacuum." Inside the chamber 210 are a sample plate 230 (or other target 230T) and an ion optics system 220, which may also be referred to herein as "ion optics" or an "ion optics assembly."

The ion optics system 220 may be configured to receive light/energy 20L from the light source 20, and to direct the light/energy 20L to the sample plate 230. The light/energy 20L can cause the sample plate 230 to generate an ion current 230C, which passes through the ion optics system 220, through a flight tube 240, and onto a detector 250, such as an ion detector 2501. The ion current 230C may have a first portion 230C-1 inside the chamber 210, and a second portion 230C-2 inside the flight tube 240 and/or incident on the detector 250. A magnitude (e.g., in Amperes) of the second portion 230C-2 may be based on, or even the same as, that of the first portion 230C-1. The ion current 230C (e.g., the second portion 230C-2 thereof) may be measured as part of a diagnostic method/mode to confirm ionization in the instrument 10. Accordingly, as used herein, the term "diagnostic" refers to a diagnostic with respect to the instrument 10 rather than with respect to a patient.

In addition to the ion current 230C, the instrument 10 may, in some embodiments, provide photons (or "photon energy") 260P from a photon source 260, such as a UV LED 260L, onto the detector 250. The photon source 260 may be at one or more of various locations inside the instrument 10, such as at a first (or base) portion 240B of the flight tube 240, as shown in FIG. 2A. The first (or base) portion 240B is at an opposite end of the flight tube 240 from a second (or top) portion 240T of the flight tube 240. In particular, the first (or base) portion 240B is adjacent the ion optics system 220, whereas the second (or top) portion 240T is adjacent the detector 250. Moreover, although the photon source 260 is shown as being inside the flight tube 240, the photon source 260 may alternatively be inside a portion of the chamber 210 that is adjacent the first (or base) portion 240B, among other locations. As further shown in FIG. 2A, the sample plate 230 may be adjacent a first end 210E of the acquisition chamber 210. The first end 210E of the acquisition chamber 210 and a second end 250E of the detector 250 may be on opposite ends/portions of the instrument 10.

Although some examples herein describe a sample on a sample plate 230, the light 20L can, in some embodiments, be directed to a test plate or other target 230T instead of the sample plate 230. Additionally or alternatively, the combination/coupling of the light source 20, the photon source 260, and the detector 250 may, in some embodiments, be referred to as a "system," such as a diagnostic system. Moreover, as the light source 20 and the photon source 260 may be a photon source and a light source, respectively, either term ("light source" or "photon source") may be used to refer to either source 20, 260. For example, the source 20 may be referred to as a "first light/photon source," and the source 260 may be referred to as a "second light/photon source."

Figure 2B:
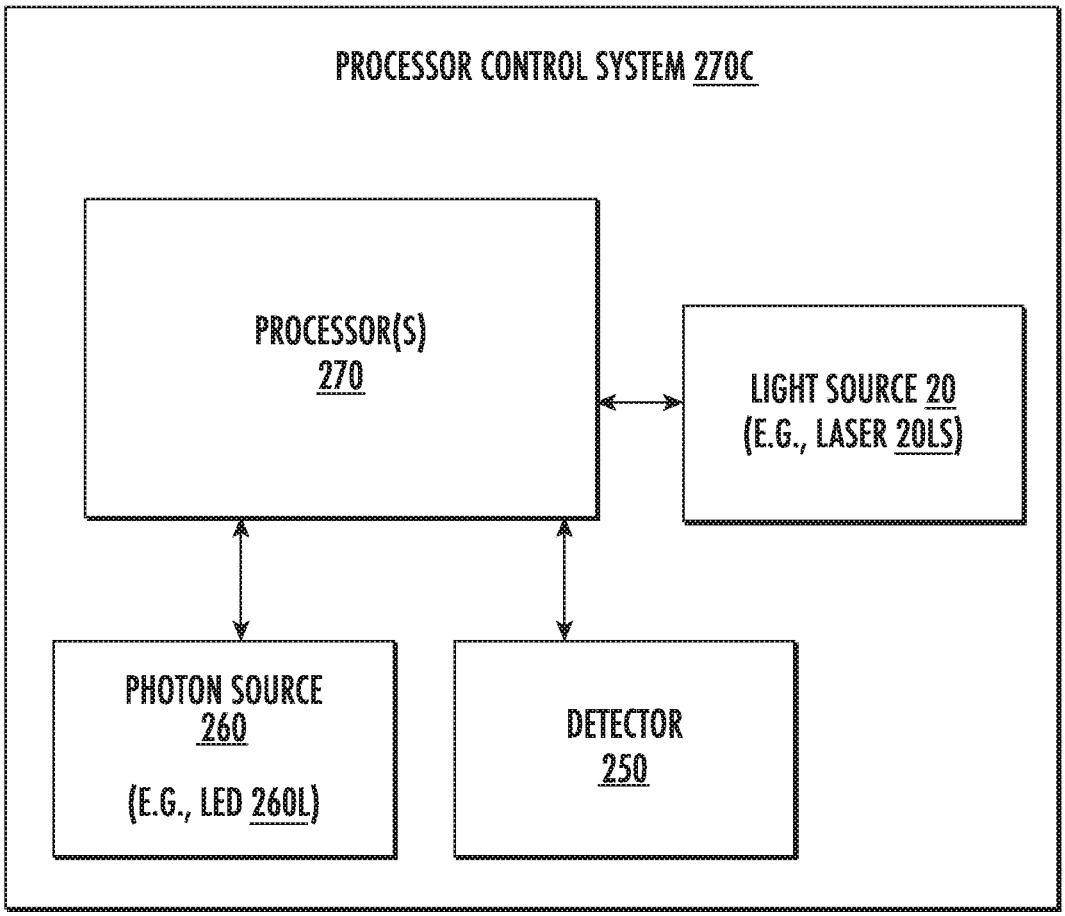
FIG. 2B is a block diagram of a processor control system of the instrument of FIG. 2A, according to embodiments of the present invention.

FIG. 2B illustrates a block diagram of a processor control system 270C. The processor control system 270C may include one or more processors 270, which may be configured to communicate with the light source 20, the detector 250, and/or the photon source 260. For example, operations of the light source 20 and/or the photon source 260 may be performed under the control of the processor(s) 270. Moreover, data generated by the detector 250 in response to receiving ions and/or photons 260P may be provided to the processor(s) 270 for processing. The processor(s) 270 may be internal and/or external to the instrument 10.

Figure 2C:
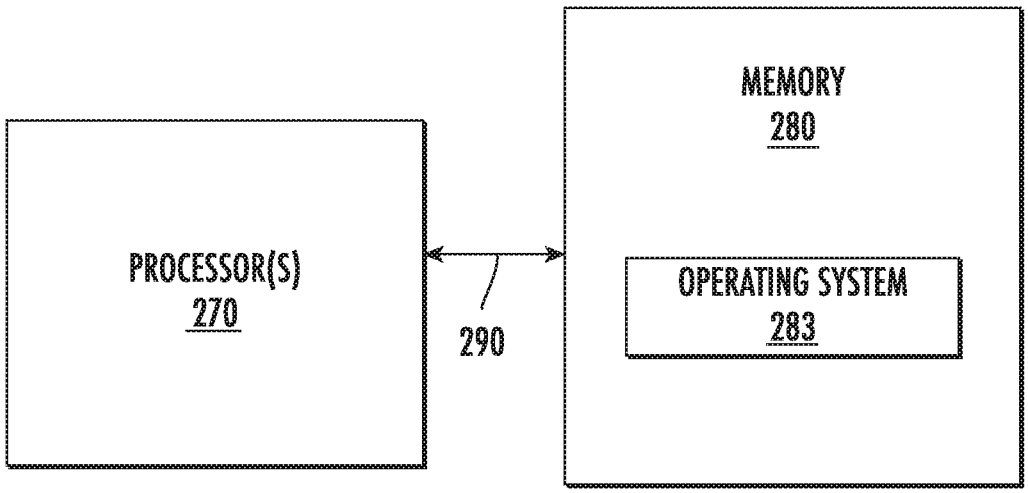
FIG. 2C is a block diagram of an example processor and memory that may be used in accordance with embodiments of the present invention.

FIG. 2C illustrates a block diagram of an example processor 270 and memory 280 that may be used in accordance with various embodiments of the invention. The processor 270 communicates with the memory 280 via an address/data bus 290. The processor 270 may be, for example, a commercially available or custom microprocessor. Moreover, the processor 270 may include multiple processors. The memory 280 is representative of the overall hierarchy of memory devices containing the software and data used to implement various functions as described herein. The memory 280 may include, but is not limited to, the following types of devices: cache, ROM, PROM, EPROM, EEPROM, flash, Static RAM (SRAM), and Dynamic RAM (DRAM).

Referring to FIG. 2C, the memory 280 may hold various categories of software and data, such as an operating system 283. The operating system 283 can control operations of the instrument 10. In particular, the operating system 283 may manage the resources of the instrument 10 and may coordinate execution of various programs by the processor 270.

Figure 3A:
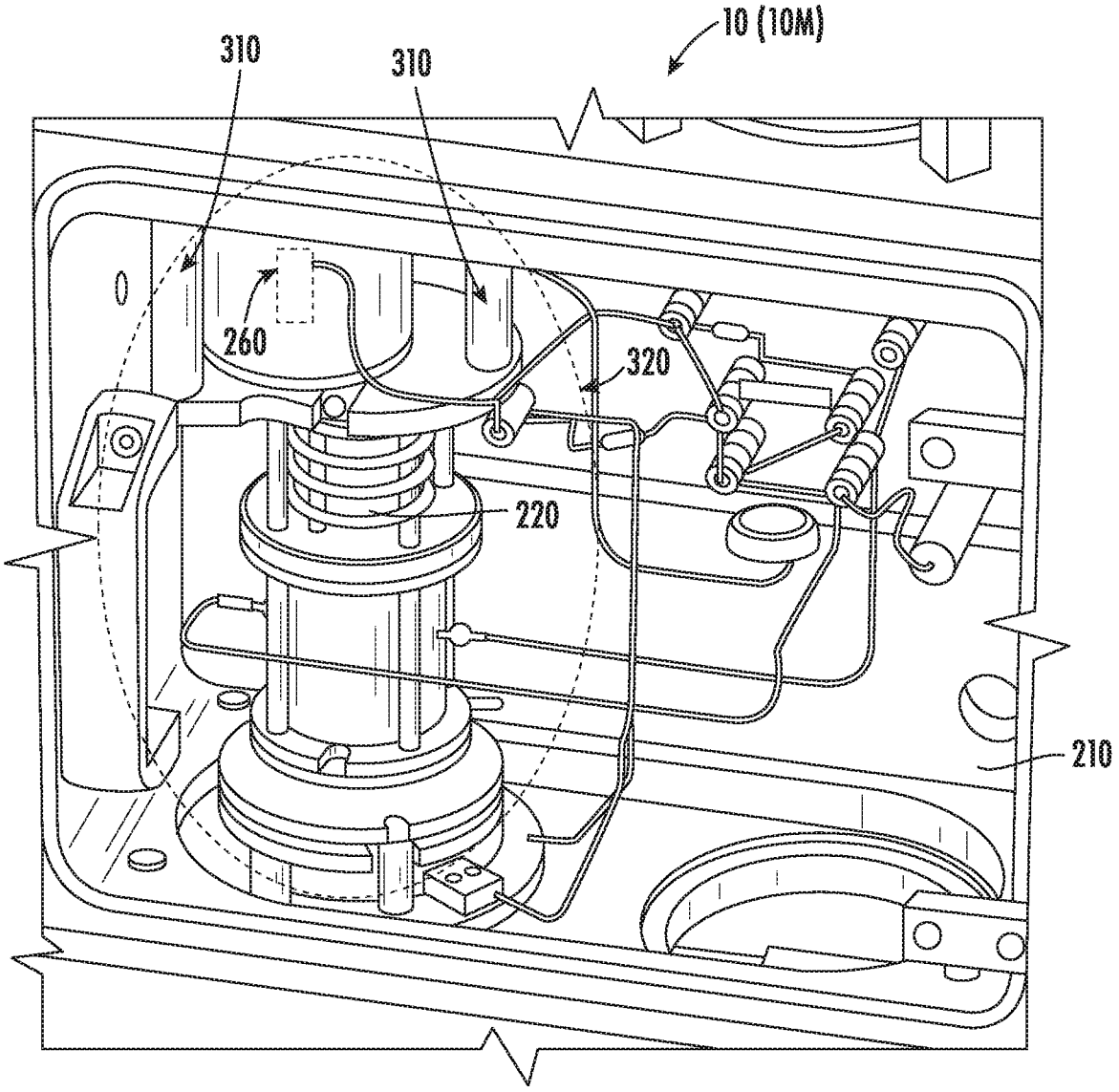
FIGS. 3A-3E are views of a Light-Emitting Diode (LED), or other photon source, according to embodiments of the present invention. In particular.

FIGS. 3A-3E illustrate views of a photon source 260, such as a UV LED 260L (FIG. 3E), that can be provided at one or more of various locations inside the housing 10*h* of an instrument 10. For example, FIG. 3A shows that the photon source 260 may be mounted in a region having dielectric standoffs 310 that hold/support ion optics 220. Moreover, in some embodiments, one or more portions of the ion optics 220 (e.g., one or more deflectors of the ion optics 220), may be removed so that the photon source 260 can be installed/placed inside the housing 10*h*. An example of a portion/region for such removal of the ion optics 220 is a removable portion/region 320.

The removed portion(s)/component(s) of the ion optics 220 may be completely removed from the chamber 210, to reduce the risk of electrically shorting any of the exposed wires in the chamber 210. In some embodiments, however, the portion(s)/component(s) may remain inside the chamber 210 if sufficient care is taken to ensure the absence of short circuits in the system.

Figure 3B:
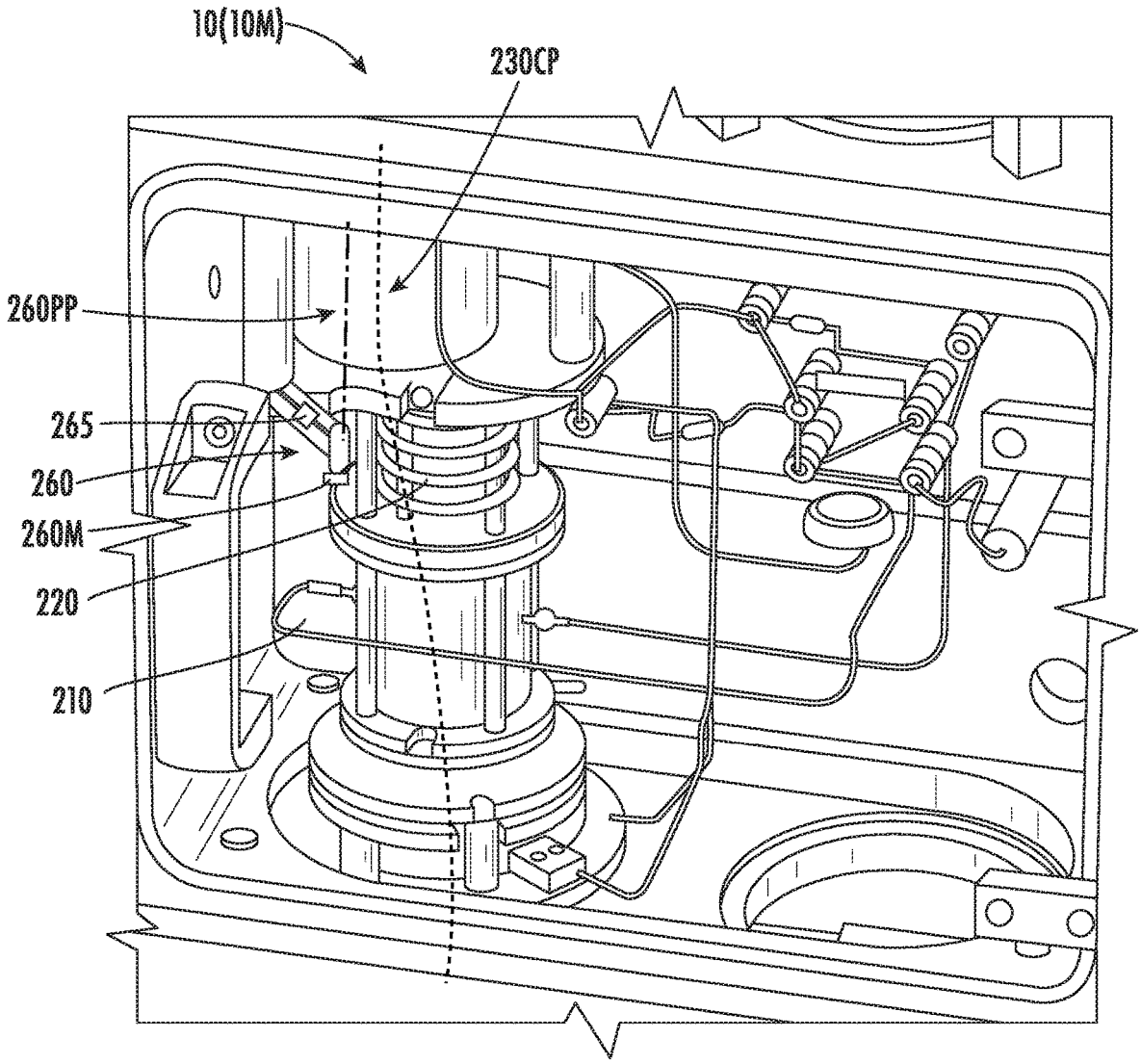

Referring to FIG. 3B, a photon path 260PP is shown for photons 260P (FIG. 2A) generated by the photon source 260. The photon path 260PP may extend in parallel with at least a portion of an ion beam path 230CP that proceeds through the ion optics 220 toward the detector 250 (FIG. 2A).

Moreover, the photon source 260 may be at one of various locations inside the housing 10*h* of the instrument 10, as long as sufficient photons 260P are incident on a Micro-Channel Plate (MCP) 261 (FIG. 3E) of the detector 250. For example, the photon source 260 may be permanently mounted within, or adjacent, the ion optics 220 in the vacuum chamber 210. Even when the photon source 260 is mounted in the ion optics 220, the photon path 260PP may not interfere with the ion beam path 230CP. As an example, the ion beam path 230CP may be directed/deflected via the ion optics 220 in a manner that avoids/inhibits interference with the photon path 260PP. In some embodiments, rather than permanently mounted, the photon source 260 may be releasably mounted/mountable in the housing 10*h*. A releasable mounting 260M for the photon source 260 may take many forms. For example, tape (e.g., KAPTON® tape) may be used to temporarily hold the photon source 260 in place. Additionally or alternatively, a socket or clip may be used to hold the photon source 260 when it is in use and to allow the photon source 260 to be removed.

Although the photon source 260 may be described herein as being temporarily/removably installed at or adjacent the base 240B of the flight tube 240 after removing other assemblies (e.g., one or more portions of the ion optics 220), the photon source 260 is limited neither to such a location nor to temporary/removable installation. Moreover, the photon source 260 may be coupled (e.g., in series) to a resistor 265.

Figure 3C:
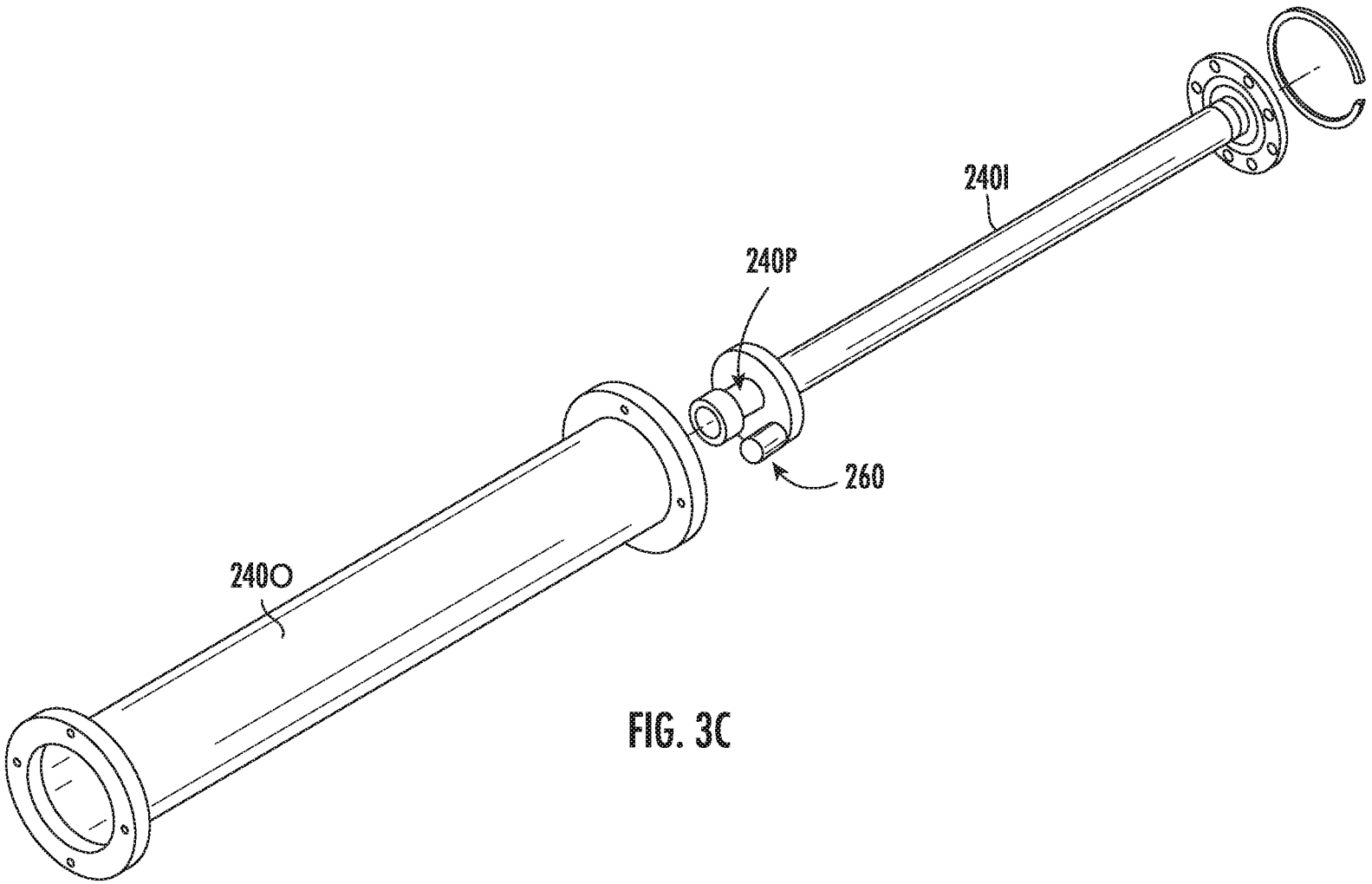

Referring to FIG. 3C, the flight tube 240 (FIG. 2A) may include an inner tube 240I and an outer tube 240O, and another possible location for the photon source 260 is between the inner tube 240I and the outer tube 240). The inner tube 240I may comprise a first cylinder that can be placed within a second cylinder provided by the outer tube 240O. Moreover, the flight tube 240 may have perforations (e.g., a perforated portion/region) 240P that allow a transmission of photons 260P that is sufficient for measurement via the detector 250.

Figure 3D:
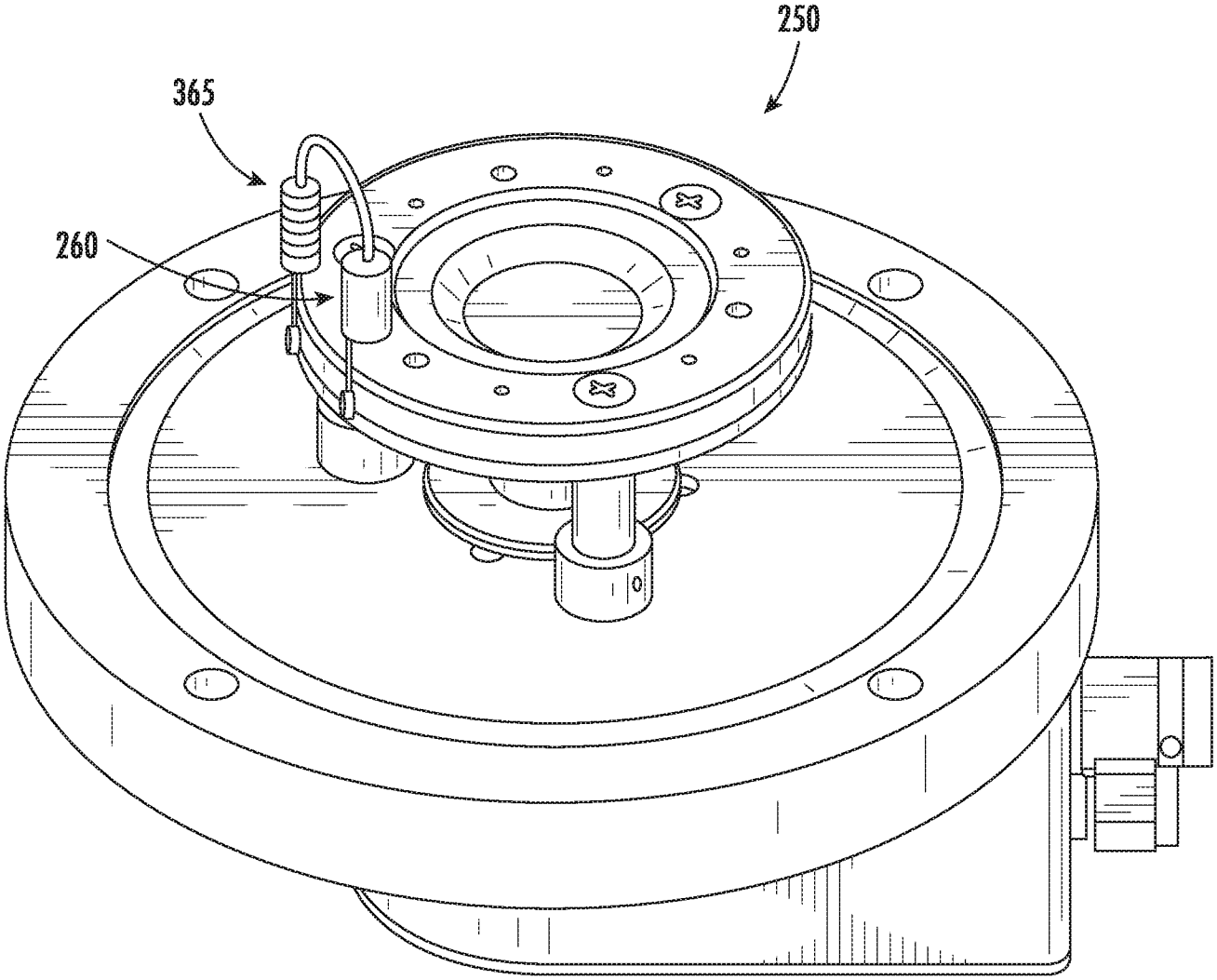
Figure 3E:
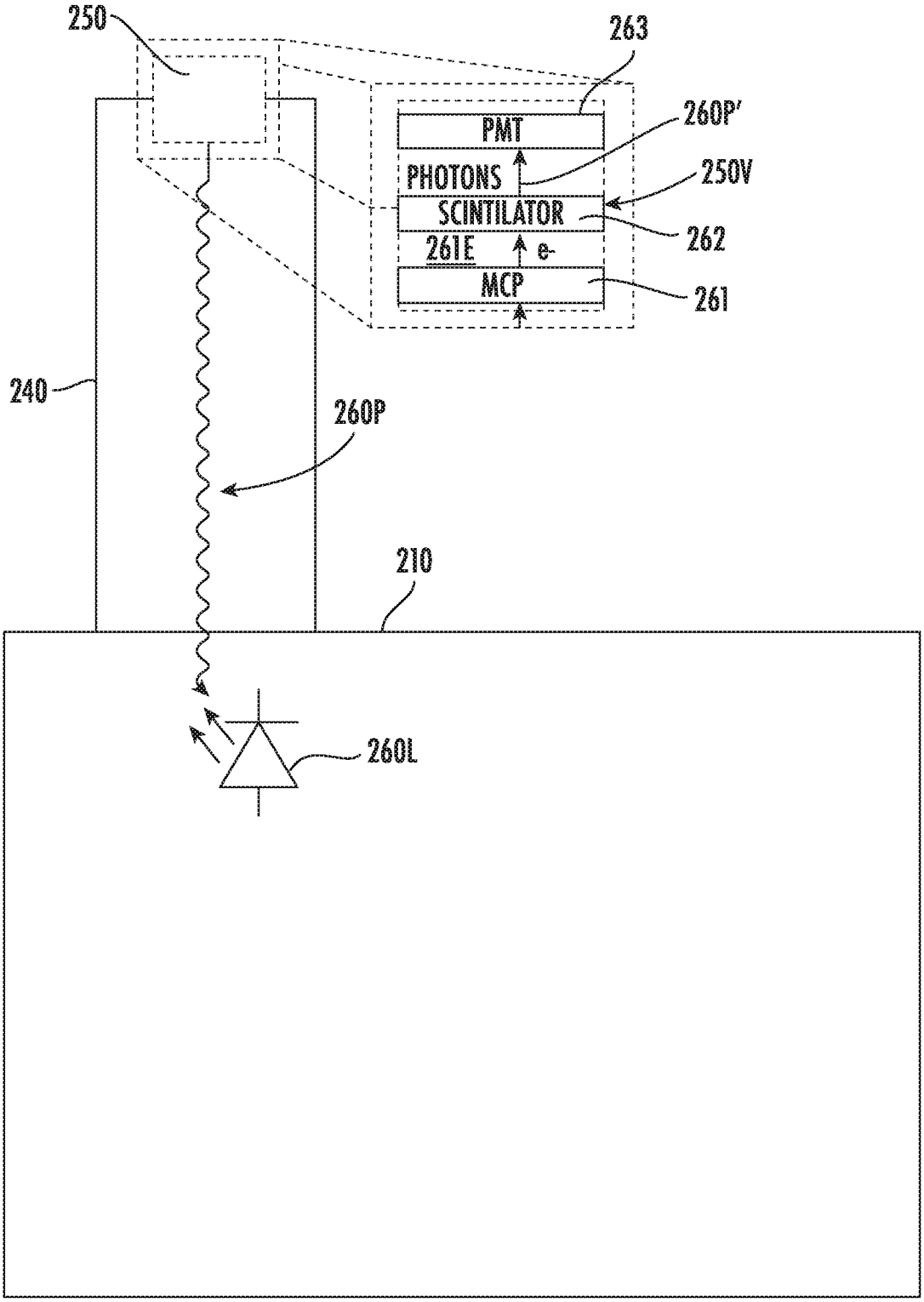

Referring to FIG. 3D, a further possible location for the photon source 260 is on the detector 250. For example, the photon source 260 can be mounted to a portion of the detector 250 that is offset from an active area provided by the MCP 261 (FIG. 3E). The photon source 260 may be connected in series to a resistor 365, which can provide a bias voltage across the MCP 261.

The resistor 365 may have a resistance value that is selected to set the voltage across the MCP 261 based on a resistive voltage divider. For example, the resistor 365 may have a resistance value between about 100 kiloohms (kΩ) and about 25 megaohms (MΩ) and may be used for diagnostic purposes. As an example, the resistance value may be about 10 MΩ. The desired MCP 261 voltage is typically 500-1,000 Volts. For example, an MCP 261 voltage of about 900 Volts may be used. The upper bound of the resistance value of the resistor 365 may be set by the internal resistance of the MCP 261, which internal resistance may be about 250 MΩ. Consequently, the maximum parallel resistance value of the resistor 365 may be about 25 MΩ to reproducibly set the voltage. The lower bound of the resistance value may be set by a variety of factors, such as MCP 261 voltage, electron energy impacting the scintillator, resistor power rating, and high voltage power supply rating.

The resistor 365 may be different from the resistor 265, which is illustrated in FIG. 3B and which may be coupled in series with the photon source 260 when the photon source 260 is at any of the locations illustrated in FIGS. 3A-3C. The resistance of the resistor 265 may be lower than that of the resistor 365. For example, the resistance of the resistor 265 may range from about 3Ω to about 19,500Ω for varied applied voltage pulses in the range of 4.5 Volts to 24 Volts (where 24 Volts is a common DC voltage bus inside of instruments). The specific resistance depends on the voltage to inhibit/prevent damage to the resistor 265 or the photon/light source 260.

Referring to FIG. 3E, the detector 250 may include an MCP 261, a scintillator 262, and a PhotoMultiplier Tube (PMT) 263. The MCP 261 can output electrons 261E, and the scintillator 262 can output photons 260P' to the PMT 263. FIG. 3E also shows that the photon source 260 (FIG. 2A) may comprise an LED 260L, such as a UV LED, that outputs photons 260P incident on the MCP 261, which then outputs the electrons 261E. As further shown in FIG. 3E, the UV LED 260L may be inside the vacuum chamber 210. Alternatively, the UV LED 260L may be inside the flight tube 240 or on the detector 250.

In some embodiments, a wavelength of the photons 260P incident on the detector 250 may be greater than 250 nm. For example, the wavelength may be about 378 nm. Any UV wavelength (10 nm to 400 nm) may be used, as any UV wavelength may be sufficient to trigger a response at the detector 250, albeit potentially with different detection efficiencies. Moreover, in some embodiments, wavelengths outside of the UV spectrum may be used.

The method(s) described herein may be used for adjusting or diagnosing detectors 250 of mass spectrometers 10M. Any detection system using an MCP 261 as the input stage, or the only stage, of a detector 250, however, may use the method(s). Such systems may include electron spectrometers, electronic displays, and night-vision goggles, among others. Moreover, although the term "ion" is described herein in various examples, the instrument 10 (including, e.g., the detector 250) is not limited to using ions, but rather may use charged particles that are different from ions. Accordingly, the current 230C (FIG. 2A) that is incident on the detector 250 may be any type of charged-particle current.

FIGS. 4A-4E illustrate flowcharts of methods for testing or adjusting an ion detector 2501, or other charged-particle detector 250, in the instrument 10. Adjusting the charged-particle detector 250 may include calibrating and/or tuning the charged-particle detector 250. In some embodiments, the memory 280 of FIG. 2C may be a non-transitory computer readable storage medium including computer readable program code therein that when executed by the processor 270 causes the processor 270 to perform the method(s) of any of FIGS. 4A-4E.

Figure 4A:
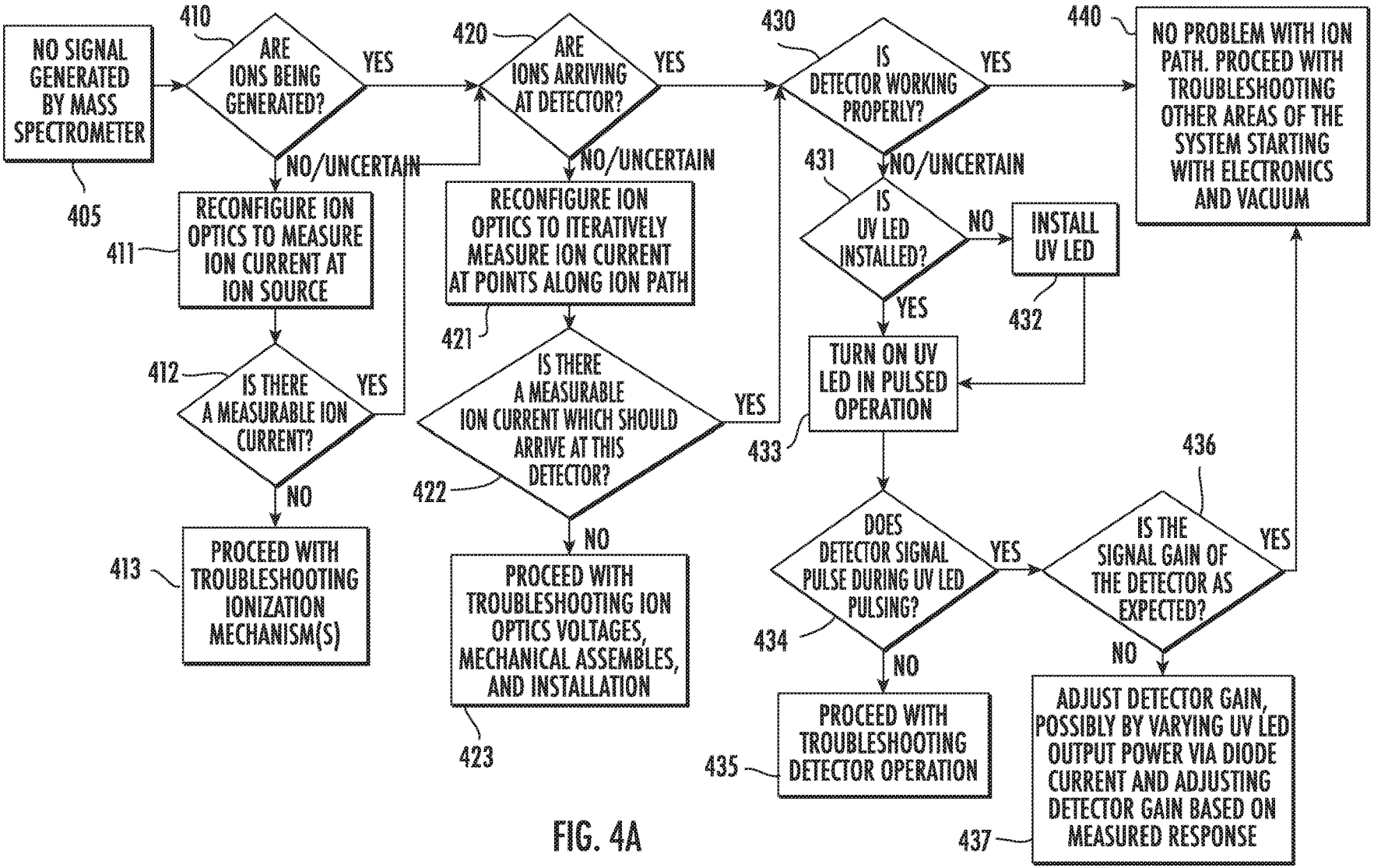
FIGS. 4A-4E illustrate flowcharts of example methods for testing or adjusting an ion detector, or other charged-particle detector, according to embodiments of the present invention.

Referring to FIG. 4A, the methods may include providing/reconfiguring (Block 411) the ion optics system 220 so that the ion current 230C inside the chamber 210 of the instrument 10 can be measured (e.g., measured via a resistor that is external to the vacuum chamber 210). The method shown in FIG. 4A may then include determining (Block 412) whether the ion current 230C is measurable. Accordingly, ionization in the instrument 10 may be confirmed based on the operations of Blocks 411 and 412.

Moreover, if the ion current 230C is measurable (Block 412), then the method may include determining (Block 420) whether ions are arriving at the detector 250. On the other hand, if the ion current 230C is not measurable (Block 412), then troubleshooting (Block 413) of ionization mechanism(s) may be performed.

If ions are arriving at the detector 250 (Block 420), then the method may include determining (Block 430) whether the detector 250 is operating properly. On the other hand, if ions are not arriving at the detector 250 or if their arrival is uncertain (Block 420), then the ion optics system 220 may be provided/reconfigured (Block 421) to iteratively measure the ion current 230C at points along a path 230CP of the ions.

The method may then including determining (Block 422) whether it detects a measurable ion current 230C that should arrive at the detector 250. If so, then the method may include determining (Block 430) whether the detector 250 is operating properly. On the other hand, if the method does not detect a measurable ion current 230C that should arrive at the detector 250 (Block 422), then troubleshooting (Block 423) of voltages, mechanical assemblies, and/or installation of the ion optics system 220 should be performed. Moreover, in some embodiments, operation of the detector 250 may be evaluated before installing the ion optics system 220.

If the detector 250 is operating properly (Block 430) and if ions are/were arriving at the detector 250 (Block 420), then it may be determined (Block 440) that the path 230CP of the ions is suitable. Moreover, in some embodiments, troubleshooting of other areas of the system/instrument 10 may be performed, including electronics troubleshooting and/or vacuum troubleshooting. If, on the other hand, the detector 250 is not working properly or the propriety of operation is uncertain (Block 430), then the method may include turning on (Block 433) a UV LED 260L (or other photon source 260) in a pulsed operation. Before turning on (Block 433) the UV LED 260L, the method may include determining (Block 431) whether the UV LED 260L is installed. If not, then the UV LED 260L may be installed (Block 432).

After turning on (Block 433) the UV LED 260L, the method may include determining (Block 434) whether the output signal of the detector 250 pulses during pulsing of the UV LED 260L. If so, then the method may include determining (Block 436) whether the signal gain of the detector 250 is as expected, such as by comparing the signal gain with a predetermined/threshold signal gain value (or with a measured signal gain value of another detector 250). On the other hand, if the output signal of the detector 250 does not pulse (Block 434) during pulsing of the UV LED 260L, then troubleshooting (Block 435) of the detector 250 may be performed.

If the signal gain of the detector 250 is not as expected (Block 436), such as by being below a predetermined/threshold signal gain value, then the method may include adjusting (Block 437) the gain of the detector 250. For example, the method may include varying the output (optical) power of the UV LED 260L (e.g., by varying the diode current) and then adjust the gain of the detector 250 based on the measured response. If, on the other hand, the signal gain of the detector 250 is as expected (Block 436), then operations may proceed to Block 440, which is described above herein.

The adjustment of the gain of the detector 250 in Block 437 is an example of "calibrating" detector gain to a known input signal. For the detector 250, the gain may be adjusted by varying the PMT 263 voltage. The gain may also be adjusted to a lesser degree, however, by modifying the MCP 261 voltage.

When the detector 250 has a known suitable value of gain for mass spectra, the response of the detector 250 may be measured for a known input to (e.g., current/voltage) and/or from (e.g., wavelength/energy) the photon source 260. Given the known input to/from the photon source 260 and the measured response of the detector 250, one or more other detectors 250 (e.g., in other systems/instruments 10) may be tuned to achieve the suitable value of gain.

Referring again to Block 411, the providing/reconfiguring of the ion optics system 220 may be performed in response to determining (Block 410) that ions are not being generated, or that their generation is uncertain. If, on the other hand, it is determined that ions are being generated (Block 410), then the method may proceed directly to determining (Block 420) whether the ions are arriving at the detector 250, and the operations of Blocks 411 and 412 may be omitted. Moreover, in some embodiments, the instrument 10 may be a mass spectrometer 10M, and the operation(s) of Blocks 410, 411, and/or 412 may be performed in response to determining (Block 405) that no signal is being generated by the mass spectrometer 10M.

Figure 4B:
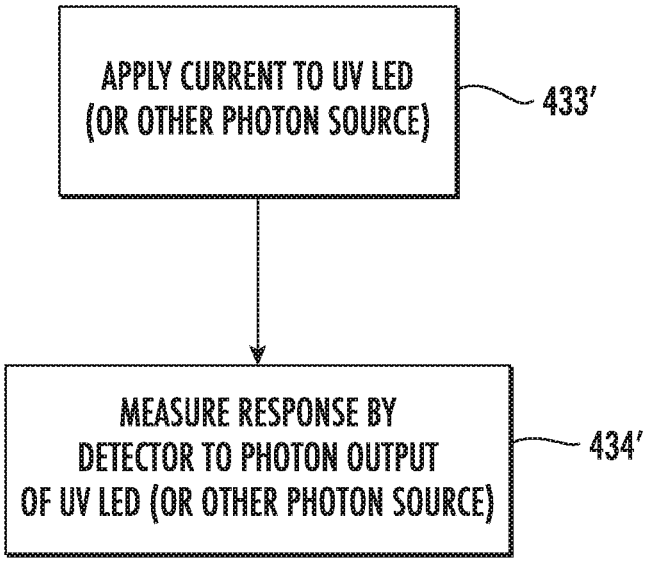

Referring to FIG. 4B, the method(s) described herein are not limited to using a pulsed operation of a UV LED 260L to test (or adjust) an ion detector 2501. For example, the operations of Blocks 433 and 434 of FIG. 4A may be performed with respect to various types of photon sources 260 and charged-particle detectors 250. In particular, FIG. 4B, in which Blocks 433' and 434' modify Blocks 433 and 434 of FIG. 4A, respectively, illustrates a method that includes applying (Block 433') current to a UV LED 260L or other photon source 260. The operation(s) of Block 433', however, may include any operation(s) of providing, from a photon source 260, photons 260P to a detector 250. For example, the photons 260P may be provided to be incident on an MCP 261 of the detector 250.

The method of FIG. 4B further includes measuring (Block 434') a response by the detector 250 to the photons 260P that are output by the photon source 260. Specifically, the response can be measured while no mass spectra are being generated (i.e., without any ionizing event) inside the instrument 10. The response may thus be independent of ion events inside the instrument 10. For example, the response can be measured while refraining from providing an ion current 230C incident on the detector 250. Moreover, in some embodiments, the operations of Blocks 433' and 434' may be preceded (or even triggered) by one or more ionization confirmation operations of Blocks 410-423 of FIG. 4A, and any measurable ion current 230C at the detector 250 may be discontinued before performing the operations of Blocks 433' and 434'.

The measuring (Block 434') operation(s) may comprise determining whether the detector 250 provides an output signal in response to the photons 260P of the photon source 260 that are incident on the detector 250. For example, this may include determining whether the output signal of the detector 250 pulses during pulsing of photons 260P of the photon source 260.

Figure 4C:
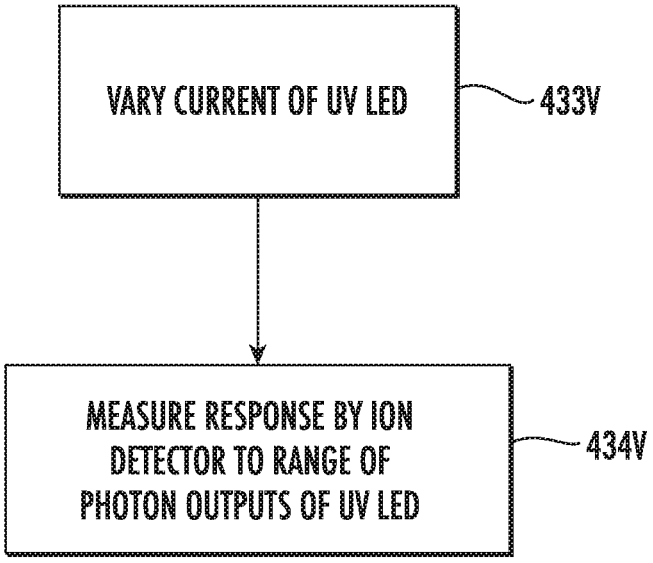

Referring to FIG. 4C, Blocks 433V and 434V modify Blocks 433' and 434' of FIG. 4B, respectively. In particular, operation(s) of applying (Block 433') current may include varying (Block 433V) current of the photon source 260. For example, the current through a UV LED 260L may be varied to generate a range of photon 260P outputs. As an example, the UV LED 260L can generate light having a varied range of output power. A response by the detector 250 to this range of outputs can then be measured (Block 434V). The operations of Blocks 433V and 434V may be performed to test a dynamic range of the detector 250.

In some embodiments, the operation(s) of adjusting (Block 437) the signal gain of the detector 250 may be performed in response to detecting such varied-output-power light at the detector 250 from the UV LED 260L or another photon source 260 inside the instrument 10. Moreover, the operation(s) of varying (Block 433V) current may comprise changing a first current of the UV LED 260L to a different (greater or lesser) second current of the UV LED 260L, and the method may further include determining that the detector 250 is functioning properly in response to determining that a change from a first output signal of the detector 250 to a different second output signal of the detector 250 is proportional to the changing of the first current to the second current. For example, the method may include confirming whether an increase or decrease in current through the UV LED 260L results in a corresponding increase or decrease, respectively, in the magnitude of the output signal of the detector 250.

Figure 4D:
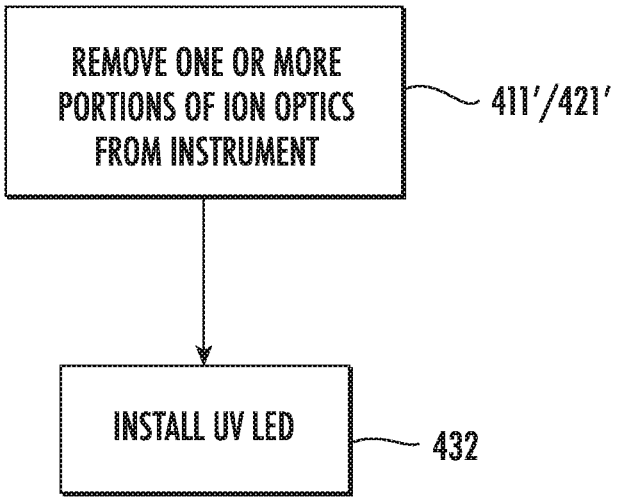

Referring to FIG. 4D, before the UV LED 260L is installed (Block 432) inside the housing 10*h* of the instrument 10, one or more portions of the ion optics system 220 of the instrument 10 may be removed (Blocks 411'/421'). Accordingly, the operation(s) of applying (Block 433' of FIG. 4B) current, or otherwise providing photons 260P to the detector 250, may be performed while the one or more portions of the ion optics system 220 is absent/removed (Blocks 411'/421').

Figure 4E:
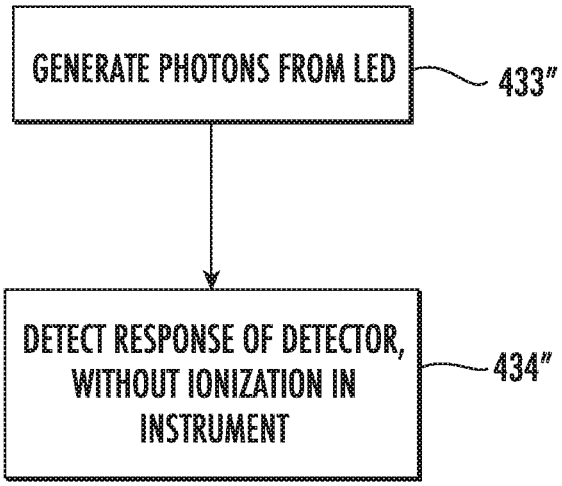

Referring to FIG. 4E, a method of the present invention may include generating (Block 433") photons 260P from an LED 260L inside the instrument 10. The operation(s) of Block 433" may include any manner of providing photons 260P from the LED 260L to the detector 250. For example, this may be performed by, but is not limited to, the operation(s) of applying (Block 433' of FIG. 4B) current. After, and/or while, generating (Block 433") photons 260P from the LED 260L, the method may include detecting (Block 434") a response by the detector 250 to the photons 260P, without (e.g., while refraining from) ionization in the instrument 10. The operation(s) of Block 434" may include any manner of identifying (e.g., confirming occurrence of) and/or evaluating (e.g., measuring a value of) the response by the detector 250.

Figure 5A:
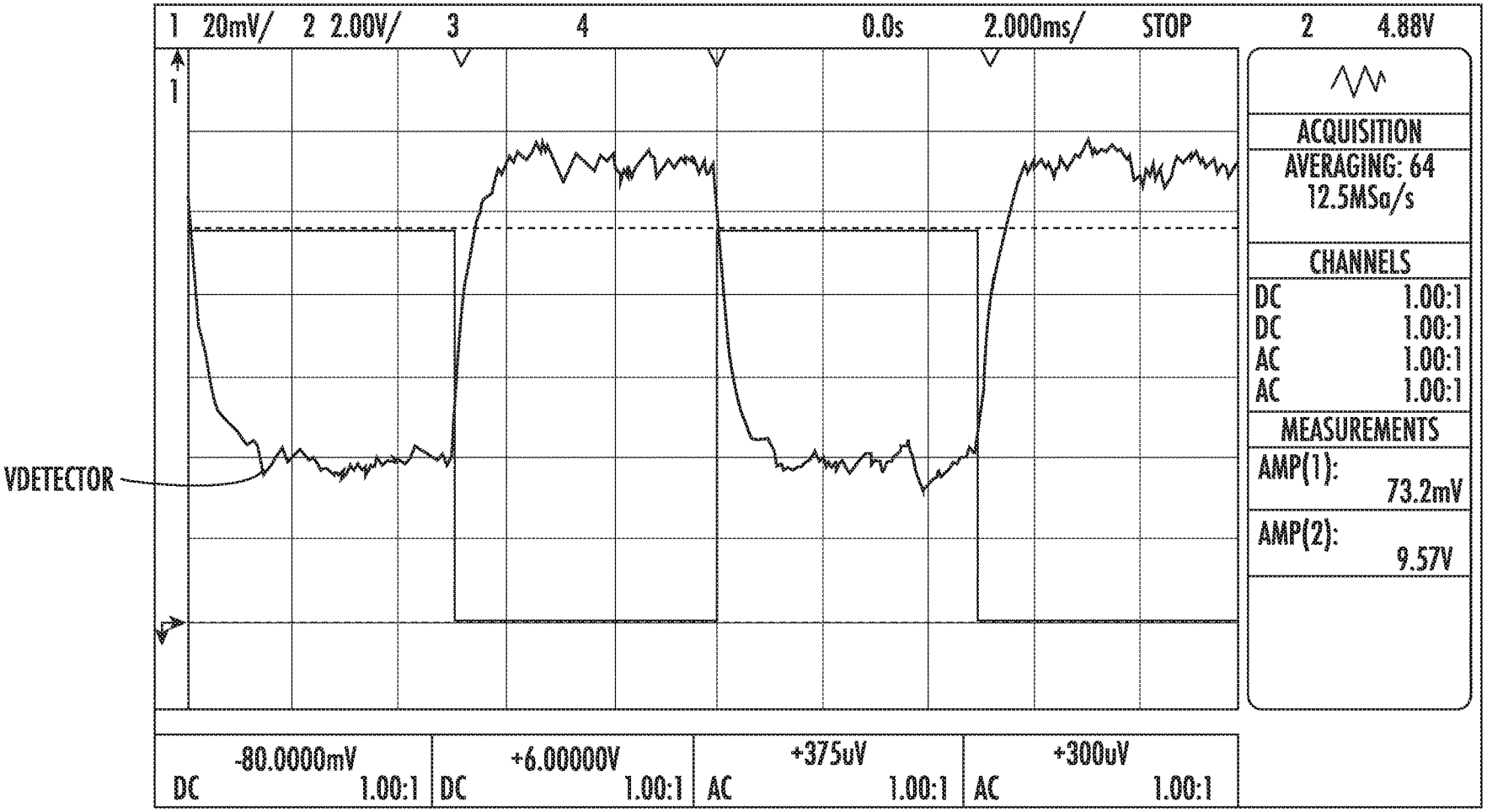
FIGS. 5A and 5B illustrate graphs of oscilloscope traces demonstrating a difference in signal intensity from an ion detector based on input current through an UltraViolet (UV) LED, according to embodiments of the present invention.
Figure 5B:
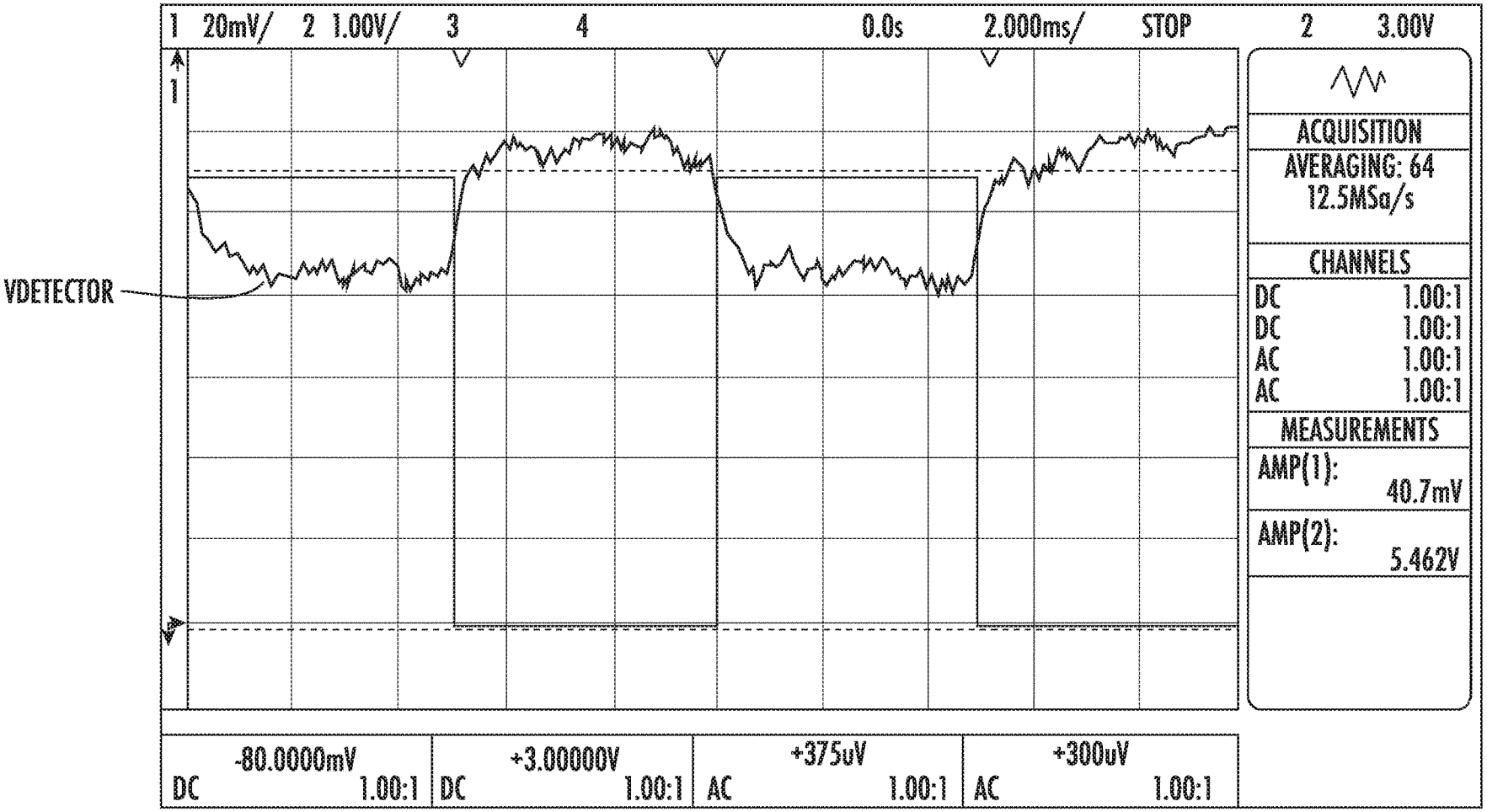

FIGS. 5A and 5B illustrate graphs of oscilloscope traces demonstrating a difference in signal intensity (e.g., in Volts or milliVolts) from an ion detector 2501 based on input current through a UV LED 260L. The dynamic range of the ion detector 2501 can be tested by varying the photon 260P output power from the UV LED 260L via its diode current and measuring the response of the ion detector 2501. A measurement of a proportional decrease in the response of the ion detector 2501 is shown in FIG. 5B, relative to FIG. 5A, for a change in diode current of the UV LED 260L. In FIGS. 5A and 5B, the first channel indicates an output signal (e.g., voltage) Vdetector of the ion detector 2501, and the second channel indicates a voltage applied to a series combination of a resistor 265 (e.g., a 1 Watt, 680 Ohm resistor) and the UV LED 260L. For example, the voltage indicated by the second channel may be provided by a voltage supply of a signal generator.

In some embodiments, sample(s) on the sample plate 230 may include a biosample from a patient, and analysis of the sample can be carried out by the instrument 10 to identify whether a defined protein or microorganism, such as bacteria, is in the sample for medical evaluation of the patient. For example, the instrument 10 may be a mass spectrometer 10M, and the analysis can identify whether any of about 150 (or more) different defined species of bacteria is in a sample, based on obtained spectra. Moreover, the path 230CP from the sample plate 230 to the detector 250 may be referred to herein as an "analysis flow path" that is enclosed by the housing 10*h* of the instrument 10. A free drift portion of the analysis flow path may be defined/provided by the flight tube 240. The target mass range can be between about 2,000-20,000 Dalton.

Figure 6A:
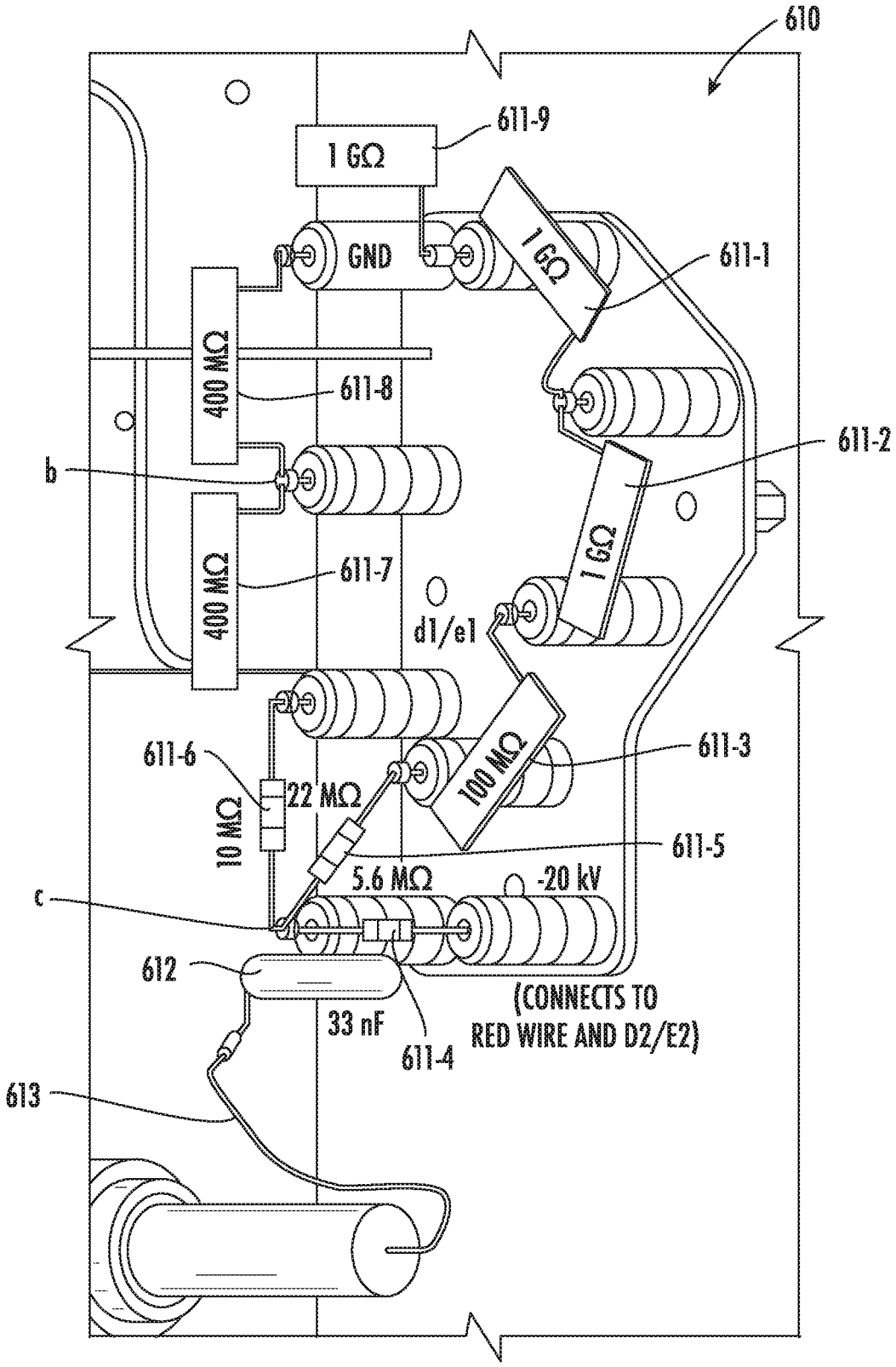
FIG. 6A is a view of an inner circuit of an instrument, according to embodiments of the present invention.

The present invention advantageously provides for testing or adjusting a detector 250 of an instrument 10 independently of MALDI operation. The following is one non-limiting example of the methods/diagnostic described herein. In this example, an LED (e.g., a UV LED) 260L may be used to test the detector 250. One or more deflectors (or other portion(s)/component(s)) of an ion optics system 220 of the instrument 10 may be removed. To maintain a voltage of a flight tube 240 of the instrument 10, an inner circuit of the instrument 10 may be wired (e.g., shorted) directly to the flight tube 240. For example, a resistive divider circuit 610 (FIG. 6A) inside the instrument 10 may be wired directly to the base 240B of the flight tube 240 via mechanical mounting hardware used in the flight tube 240. As an example, the resistive divider circuit 610 may be wired near a retaining ring that is opposite the photon/light source 260 in FIG. 3C.

For the purposes of this test, ion optics 220 sections (portions/components in the dashed oval of FIG. 6B) may be removed. If they are removed, then connection point c (FIG. 6A) from the resistive divider circuit 610 can no longer be wired to connection point c on the ion optics 220. Consequently, connection point c on the resistive divider circuit 610 may instead be wired directly to the base 240B of the flight tube 240 via the mechanical mounting hardware used in the flight tube 240.

Figure 6B:
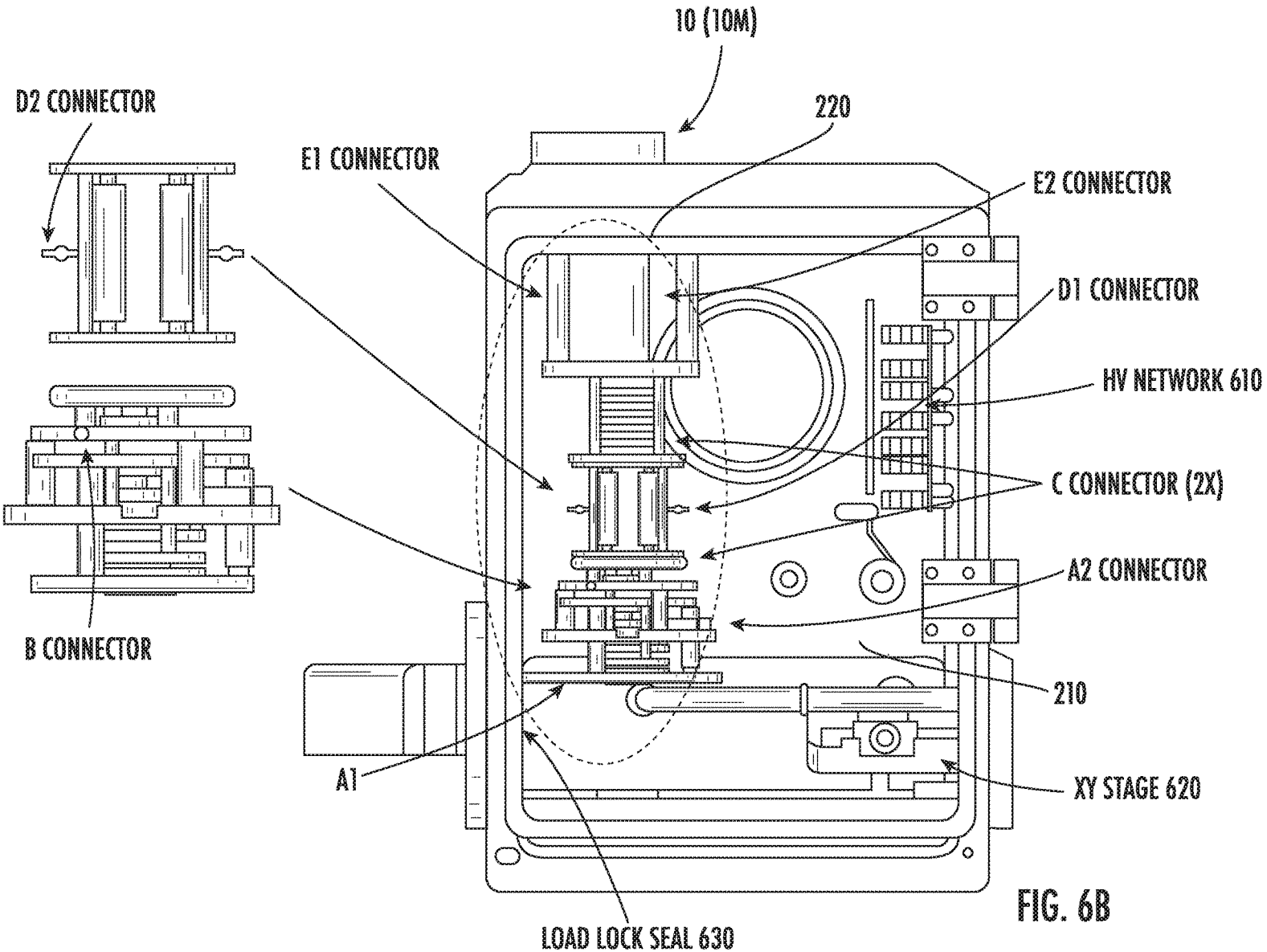
FIG. 6B is a partially transparent side perspective view of an internal portion of an instrument, according to embodiments of the present invention.

The resistive divider circuit 610 may include a plurality of resistors 611 (e.g., 611-1 to 611-9). The resistive divider circuit 610, which may be referred to as a high voltage (HV) network (FIG. 6B), may also include a capacitor 612 and may connect to a wire 613 (which may be referred to as the "red wire"). Moreover, an input voltage at a point a1 (FIG. 6B) inside the chamber 210 may be variable from 0-100 VDC, an input voltage at point a2 may be variable in magnitude from −4 kV-0 V (with a fixed pulsewidth of 10 microseconds (μs) and a rise time of about 50 nanoseconds (ns)). Furthermore, FIG. 6B illustrates that the instrument 10 may include an x-y stage 620 and a load lock seal 630, as well as a plurality of connectors (e.g., connectors/connection points a1, a2, b, c, d1, d2, e1, e2).

The LED 260L may be wired to a Safe High Voltage (SHV) feedthrough of the instrument 10 via a resistor 265, such as a 680 Ohm, 1 Watt resistor. A 0-10 Volts square wave may be applied via a function generator to turn on the LED 260L, which may emit 7 milliWatts of optical power at 378 nm for a forward current of 20 milliAmps. High voltages may be turned on for the instrument 10, which may help to facilitate a response by the detector 250 to the LED 260L.

As shown in FIGS. 5A and 5B, the detector 250 can output an unambiguous response to the signal (e.g., photons 260P) from the LED 260L. Accordingly, the LED 260L can be used to confirm suitable operation of the detector 250 and/or to calibrate the detector 250. Moreover, current can be stepped through the LED 260L to test the dynamic range of the detector 250.

In some embodiments, the response of the detector 250 may be compared with responses by one or more other detectors 250. For example, it may be desirable to confirm whether the gain of a group of detectors 250 is similar.

The present invention's use of photons 260P inside the instrument 10 allows testing (or adjusting) the response of the detector 250 independently of ion events. In some embodiments, this response is due to cycling/pulsing the photon source 260 on and off. As it may be relatively easy to vary current through LEDs, it may be advantageous to use an LED 260L as the photon source 260.

The LED 260L can be used to modify or set the gain of the detector 250 based on the known output of the LED 260L. For example, this can be performed to calibrate the detector 250 or as a binary confirmation (YES or NO) of whether the detector 250 is working properly. In contrast with using the LED 260L, conventional mass spectrometers may use a sample and then adjust detector gain based on a signal generated with the sample. Use of the LED 260L with a known wavelength by embodiments of the present invention is believed to be more repeatable than conventional techniques that use samples, due to the inherent variability between different samples. As an example, the present invention can advantageously apply a known/constant current through the LED 260L having a known output wavelength, thus providing a relatively repeatable technique for measuring the response of the detector 250.

In the figures, certain layers, components, or features may be exaggerated for clarity, and broken lines illustrate optional/removable features or operations unless specified otherwise. The terms "FIG." and "Fig." are used interchangeably with the word "Figure" in the application and/or drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms "first," "second," etc. may be used herein to describe various elements, components, regions, layers, and/or sections, these elements, components, regions, layers, and/or sections should not be limited by these terms. These terms are only used to distinguish one element, component, region, layer, or section from another region, layer or section. Thus, a "first" element, component, region, layer, or section discussed below could be termed a "second" element, component, region, layer, or section without departing from the teachings of the present invention.

Spatially relative terms, such as "beneath," "below," "bottom," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass orientations of above, below and behind. The device may be otherwise oriented (rotated 90° or at other orientations) and the spatially relative descriptors used herein interpreted accordingly.

The term "about" refers to numbers in a range of +/−20% of the noted value.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, steps, operations, elements, and/or components, but do not preclude the presence or addition of one or more other features, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items. Moreover, the symbol "/" has the same meaning as the term "and/or."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

In some embodiments, the mass spectrometer 10M is configured to obtain an ion signal from a sample that is in a mass range of about 2,000 to about 20,000 Dalton.

The term "sample" refers to a substance undergoing analysis and can be any medium within a wide range of molecular weights. In some embodiments, the sample is being evaluated for the presence of microorganisms such as bacteria or fungi. The sample, however, can be evaluated for the presence of other constituents, including toxins or other chemicals.

The term "table top" refers to a relatively compact unit that can fit on a standard table top or counter top or occupy a footprint equivalent to a table top, such as a table top that has width-by-length dimensions of about 1 foot by 6 feet, for example, and which typically has a height dimension that is between about 1-4 feet. In some embodiments, the instrument/system resides in an enclosure or housing of 28 inches-14 inches (W)×28 inches-14 inches (D)×38 inches-28 inches (H). The flight tube 240 may have a length of about 0.8 meters (m). In some embodiments, longer or shorter lengths may be used. For example, the flight tube 240 may have a length that is between about 0.4 m and about 1 m. The flight tube 240 can be referred to as being "in communication with" the charged-particle detector 250. As used herein, the phrase "in communication with" may refer to physical, optical, electrical, wired, and/or wireless connection(s).

The foregoing is illustrative of the present invention and is not to be construed as limiting thereof. Although a few example embodiments of this invention have been described, those skilled in the art will readily appreciate that many modifications are possible in the example embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A diagnostic and/or adjustment method for a charged-particle detector of a mass spectrometer, the method comprising:

providing, from a photon source, photons incident on the charged-particle detector; and detecting a response by the charged-particle detector to the photons incident thereon, without any ionizing event in the mass spectrometer.

2. The method of claim 1, wherein the charged-particle detector comprises an ion detector, wherein the photon source comprises a Light-Emitting Diode (LED), and wherein the detecting comprises determining whether the ion detector provides an output signal in response to light from the LED.

3. The method of claim 2, wherein the providing photons is carried out by pulsing the light from the LED.

4. The method of claim 3, further comprising:

comparing a signal gain of the ion detector with a predetermined value or with a measured signal gain of another ion detector, in response to the output signal of the ion detector.

5. The method of claim 4, further comprising:

adjusting the signal gain of the ion detector, in response to determining that the signal gain of the ion detector does not match the predetermined value and/or does not match the measured signal gain of the another ion detector.

6. The method of claim 2, further comprising:

varying current of the LED that generates the light; and adjusting a signal gain of the ion detector.

7. The method of claim 2, wherein the LED comprises an UltraViolet (UV) LED, wherein the providing photons comprises changing a first current of the UV LED to a second greater or lesser current of the UV LED, and wherein the method further comprises determining that the ion detector is functioning properly, in response to determining that a change from a first output signal of the ion detector to a second output signal of the ion detector is proportional to the change of the first current of the UV LED to the second current of the UV LED.

8. The method of claim 2, further comprising testing a dynamic range of the ion detector by:

varying a current applied to the LED; and measuring the response by the ion detector to a range of photon outputs generated by the varying the current of the LED.

9. The method of claim 2, further comprising:

removing one or more portions of an ion optics system from a housing of the mass spectrometer that includes a flight tube that is in communication with the ion detector, wherein the providing and detecting are performed while the one or more portions of the ion optics system is removed.

10. The method of claim 2, further comprising:

determining whether ions are being generated inside the mass spectrometer by light from a light source different from the LED; and determining whether the ions are arriving at the ion detector, wherein the providing and detecting are performed in response to the determining that the ions are arriving at the ion detector.

11. The method of claim 1, wherein the providing photons comprises applying current to the photon source to provide the photons incident on a Micro-Channel Plate (MCP) of the charged-particle detector.

12. The method of claim 1, further comprising:

determining whether ions are arriving at the charged-particle detector, wherein the providing photons is performed without providing ions to the charged-particle detector, in response to determining that the ions are arriving at the charged-particle detector.

13. The method of claim 12, further comprising:

determining whether the ions are being generated by light from a light source, before the determining that the ions are arriving at the charged-particle detector; and determining that no signal is being generated by the mass spectrometer, wherein the determining whether the ions are being generated by the light from the light source is performed in response to the determining that no signal is being generated by the mass spectrometer.

14. The method of claim 1, further comprising varying optical power of the photon source.

15. A mass spectrometer comprising:

a housing enclosing an analysis flow path;

a charged-particle detector;

a light source configured to provide light inside the housing to generate ions incident on the charged-particle detector; and a photon source configured to generate photons incident on the charged-particle detector.

16. The mass spectrometer of claim 15, further comprising a flight tube in the housing and defining a free drift portion of the analysis flow path, wherein the charged-particle detector is in communication with the flight tube and comprises a Micro-Channel Plate (MCP).

17. The mass spectrometer of claim 16, wherein the photon source is at or adjacent a base portion of the flight tube.

18. The mass spectrometer of claim 16, wherein the flight tube comprises first and second cylinders, and wherein the photon source is between the first and second cylinders.

19. The mass spectrometer of claim 18, wherein the photon source is adjacent a perforated portion of one of the first and second cylinders.

20. The mass spectrometer of claim 15, wherein the light source comprises a laser.

21. The mass spectrometer of claim 15, wherein the photon source comprises a Light-Emitting Diode (LED) configured to generate LED light to provide the photons incident on the charged-particle detector.

22. The mass spectrometer of claim 21, wherein the LED is in series with a resistor comprising a resistance value that is between 3 Ohms and 19,500 Ohms.

23. The mass spectrometer of claim 21, wherein the LED comprises an UltraViolet (UV) LED that is releasably mountable in the housing.

24. The mass spectrometer of claim 15, further comprising an ion optics system through which the ions are configured to pass toward the charged-particle detector.

* * * * *